United States Patent [19]

Boussaroque

[11] 4,365,371

[45] Dec. 28, 1982

[54] MATTRESSES WITH STIFFENERS

[76] Inventor: Bertrand J. Boussaroque, 163 boulevard Clémenceau, Marcq-en-Baroeul, France

[21] Appl. No.: 141,721

[22] Filed: Apr. 18, 1980

[30] Foreign Application Priority Data

May 29, 1979 [FR] France ..... 79 14645

[51] Int. Cl.[3] ..... A47C 27/14; A47C 27/16

[52] U.S. Cl. ..... 5/462

[58] Field of Search ..... 5/462, 464, 474

[56] References Cited

U.S. PATENT DOCUMENTS

| | | | |
|---|---|---|---|
| 1,347,666 | 7/1920 | Amey | 5/463 |
| 2,543,218 | 2/1951 | Young et al. | 5/462 X |
| 2,576,455 | 11/1951 | Gratt | 5/500 X |
| 3,027,967 | 4/1962 | Silver | 5/464 X |
| 3,110,042 | 11/1963 | Slemmons | 5/462 X |
| 3,319,274 | 5/1967 | Upton | 5/481 |
| 3,534,416 | 10/1970 | Ackermann | 5/462 X |
| 3,534,417 | 10/1971 | Boyles | 5/462 |
| 3,538,521 | 11/1970 | Basner | 5/462 |
| 4,080,675 | 3/1978 | Kanowsky et al. | 5/462 X |

FOREIGN PATENT DOCUMENTS

| | | | |
|---|---|---|---|
| 1940763 | 1/1971 | Fed. Rep. of Germany . | |
| 2446092 | 9/1980 | France | 5/462 |
| 439627 | 12/1967 | Switzerland . | |
| 1304373 | 1/1973 | United Kingdom | 5/464 |

*Primary Examiner*—Stephen J. Novosad
*Assistant Examiner*—George A. Suchfield
*Attorney, Agent, or Firm*—Martin A. Farber

[57] ABSTRACT

Improvements in mattresses having stiffeners, particularly foam mattresses. Slits are made by at least one perpendicular incision on one side of the padding or foam portion of the mattress, the end of each incision constituting a hinge for the padding portions of the mattress which remain connected together on opposite sides of the incision, and which is opened in the manner of a book. Stiffeners are placed in at least one of the slits, the stiffeners being in the form of stiff laths connected side by side, the laths being slipped into tubular sheaths which are connected to each other and which have profiles and cross-sections corresponding to the laths. A padded and quilted cover is formed on the sides of the mattress with another slit over at least a portion of the periphery and a slide fastener is mounted in this slit.

11 Claims, 5 Drawing Figures

MATTRESSES WITH STIFFENERS

FIELD OF THE INVENTION

The present invention relates to improvements in mattresses, particularly foam mattresses, provided with stiffeners.

THE EXISTING PROBLEM

With the lack of physical exercise and on the other hand, the stresses of modern life, the spinal column and the kidneys are subjected to repeated microtraumatisms which result in discomfort. It is attempted to remedy this by sleeping on soft mattresses whose apparent comfort is more harmful and results in an aggravating of this discomfort.

PRIOR ART AND DRAWBACKS

This is remedied by mattresses of different hardness. There are mattresses the two faces of which are of different hardness. Some even go so far as to place boards under or even on the mattress. In this case the utmost in discomfort is achieved.

In French Patent Application No. 7901043 (French Pat. No. 2,446,092) a solution is proposed consisting of a pocket in which stiffeners are placed. However, these pockets have proven difficult to produce and it is difficult to slide the stiffeners in them so that they come to the desired place.

Moreover, the solution of a stiffener with a single board as is contemplated in that patent application does not hold the body of a person lying on it in place, the body rather having a tendency to roll to one side or the other.

Various other patents have moreover provided systems of stiffening using a single board. Mention may be made of the following patents:

French Pat. No. 2 002 306 in the name of COLCHONES ANATOMICOS in which the mattress has a transverse slit into which a rigid board which is parallel to the upper face can be introduced, but this solely in the central portion of the mattress. The elastic blocks which form this mattress have different degrees of compactness in order to provide different degrees of hardness. Therefore it is not possible to effect an adjustment of the rigidity or elasticity at desired points of the mattress.

German Pat. No. 1 940 763 in the name of BETTENZELLEKENS which concerns a mattress having a cover with slide fastener, a core of padding having a plurality of separate layers and a board which can be inserted therein. These superimposed layers have the drawback that they can slide on each other and cannot hold the board in position if the board is of an area smaller than that of the mattress. It is therefore not possible to select the places of the mattress where the rigidity and elasticity are to be modified.

Swiss Pat. No. 439 627 in the name of SCHNYDER, provides one or two boards inserted in final manner within the foam of the mattress. There is thus no possibility of adjusting the elasticity.

Mention may also be made of U.S. Pat. No. 3,538,521 which provides an auxiliary mattress having transverse pockets into which wooden laths are placed. The thickness of the sponge material between the outer faces of the mattress and the said laths is constant. The elasticity of the mattress can therefore not be adjusted.

One will note the absence in the case of double mattresses of any solution which provides different hardnesses on the right-hand and left-hand sides, and in the case of mattresses which are to be placed on hinged boxsprings.

The present invention is intended to overcome these drawbacks.

DESCRIPTION OF THE INVENTION

The mattresses of the invention are characterized primarily by combining:

(a) slits formed by at least one perpendicular incision on one side of the padding or foam portion of the mattress, the end of each incision constituting a hinge for the padding portions of the mattress which remain connected together on each side of the incision which opens like a book, (b) Stiffeners placed in at least one slit, the stiffeners being in the form of a plurality of laths connected side by side, and slipped into tubular sheathings of cross sections and profiles corresponding to the laths which are connected to each other, (c) a padded and quilted cover having, on the sides of the mattress, a slit over at least a portion of the periphery, which slit is provided with a slide fastener.

In accordance with a preferred embodiment, the mattress has a plurality of parallel incisions or slits which define between themselves and the two large faces of a mattress, different thicknesses of foam between each of the slits or incisions and one large face of the mattress.

The connection of a plurality of adjacent stiffeners intended to be placed in one and the same slit is effected by two superimposed rectangular sheets of fabric connected or sewn parallel to one of their edges. The lengths of the sheaths thus produced are equal to or definitely smaller than those of the stiffeners and the connection between each sheath permits a certain movement of the stiffeners with respect to each other. In general, the stiffeners of a series which is located in the same slit or incision have different lengths and widths, the central stiffener or stiffeners being wider and longer; however, other arrangements of sizes of stiffeners can be used without going beyond the scope of the invention.

The slits or incisions may be produced either from a single large side of the mattress in such a manner that the hinges are parallel to said side (the hinges are on the side) or from both two lateral large sides of the mattress in such a manner that the hinges are parallel to said sides, the slits or incisions being present over only slightly less than the width of the mattress (the hinges are in the middle), or else from at least one small side of the mattress in the manner that the hinges are parallel to said sides and extend over a portion of the length of the mattress. This last-mentioned embodiment is intended more particularly for mattresses for hinged mattress springs which make it possible to raise ones head or legs, or both at the same time. One can thus provide different hardnesses of the mattress for the legs and the back. This type of bed is used, for instance, in hospitals. This arrangement also makes is possible to insert, within the thickness of the mattress, in an incision which may be different from the one in which the stiffeners are located, a cushion of the desired thickness and elasticity at the place desired for the treatment of back disorders. Instead of a cushion a hard object shaped in accordance with medical requirements can even be provided there.

In the event that the slit or incision is made along a large side of the mattress, in order to prevent the outer padded and quilted cover from moving with respect to the foam, the loop-shaped handles for the handling of the said mattress which are customarily arranged on the long lateral sides of the mattress pass both through the padded cover and the foam of the mattress at the end of the slits and incisions at the level of the latter.

The mattress may be formed of a single padded cover and a single block of foam having an incision over its two long sides for a double bed, or else, in the case of a double mattress, by arranging two separate slit blocks of foam side by side within the same cover.

SOLUTION OF THE PROBLEM, ADVANTAGES AND INDUSTRIAL RESULT

The arrangement provided by the invention makes it possible more easily to adjust the hardness of the mattress and to place the stiffeners easily in the desired place therein. The producing of the incision in the foam is easier. Greater stability of the cover with respect to the inner padding is obtained and a solution is provided for mattresses intended for patients in hospitals. Furthermore, the lateral stability of the person lying on the mattress is improved.

The invention will be better understood on basis of the following description given of two non-limiting practical embodiments which are illustrated in the accompanying drawings.

DESCRIPTION OF TWO EMBODIMENTS

Figure 1:
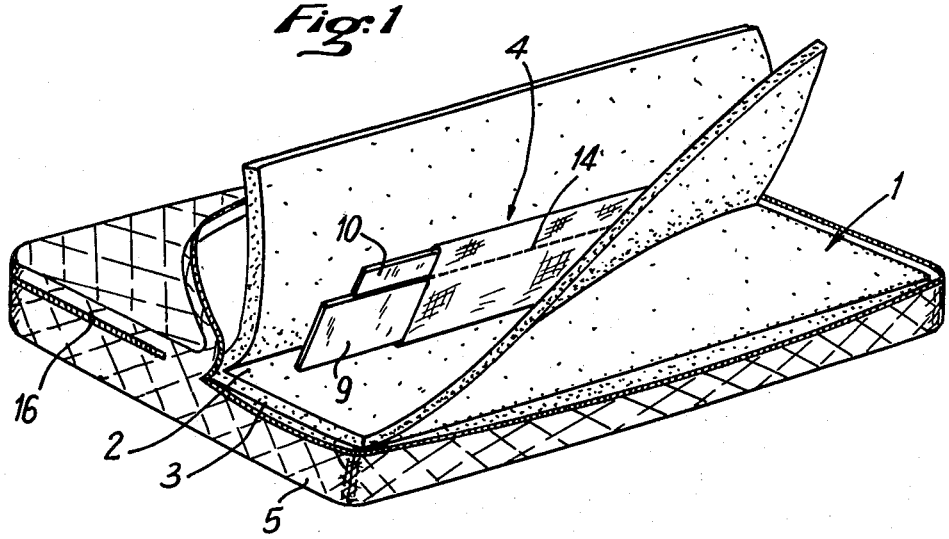
FIG. 1 is a perspective view of a double mattress opened so as to show the arrangement of a stiffener.
Figure 2:
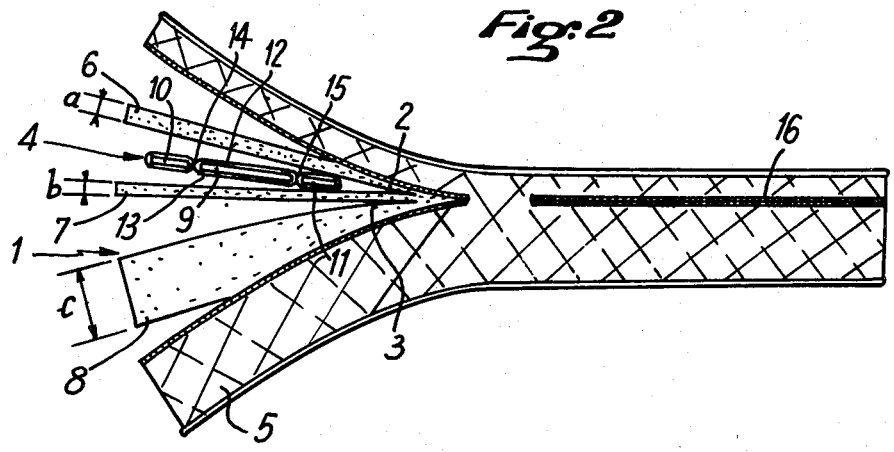
FIG. 2 is a side view of the same double mattress in open position.

Referring to FIGS. 1 and 2, it is seen that the double mattress is formed of a block of foam 1 which is sliced four times on a large side such as at 2 and 3, of at least one stiffener 4, and of a padded, quilted cover 5.

The block of foam 1 therefore has, on the right and on the left, two incisions 2 and 3 the end of which constitutes a hinge for three thicknesses of foam 6,7,8 the thicknesses of which are indicated (FIG. 2) by a, b and c respectively. These foam thicknesses 6,7,8 open up like the pages of a book and make it possible easily to slide the stiffener 4 into the desired place therein. The thicknesses a,b,c are selected in such a manner that, in combination, different stiffeness of free foam can be obtained. For example, a is selected as equal to 5 cm, b is equal to 3 cm and c is equal to 7 cm. If one abstained from inserting the stiffener 4 one would therefore have a mattress containing a thickness of foam of 15 cm. By placing the stiffener 4 between the thickness 6 and the thickness 7 one obtains an active thickness of foam of over 5 cm; on the other hand, if one turns the mattress one has a thickness of active foam of 10 cm. By placing the stiffener 4 between the foam thicknesses 7 and 8 one obtains a thickness of active foam of 8 cm on one side of the mattress and of 7 cm if the mattress is turned over, The stiffener 4 is formed of a wide central lath 9 and two narrower lateral laths 10 and 11. The laths 9, 10, 11 are slid into tubular fabric sheaths formed of two rectangular sheets 12, 13 which are superimposed and connected and sewn parallel to their edge and to the axis of the laths 9,10,11. There are also seams 14,15 between two adjacent laths, these seams being provided in order to permit a certain movement between the laths. It should also be pointed out that it is preferred to impart the central lath 9 a greater length than the two side laths 10 and 11. This arrangement makes it possible for the mattress to place itself in the shape of a trough under the weight of the person lying thereon and prevent him from rolling onto the side.

Figure 4:
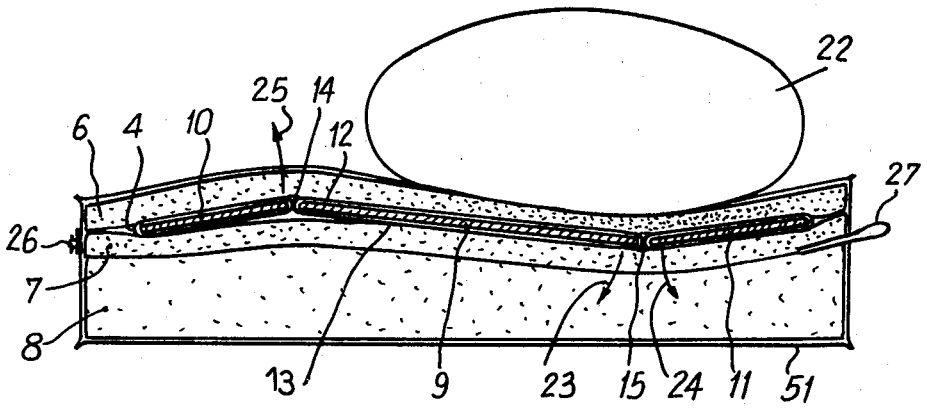
FIG. 4 is a cross section through a mattress with a person lying thereon, said section showing how the padding foam deforms and the stiffeners move under the weight of said person.
Figure 5:
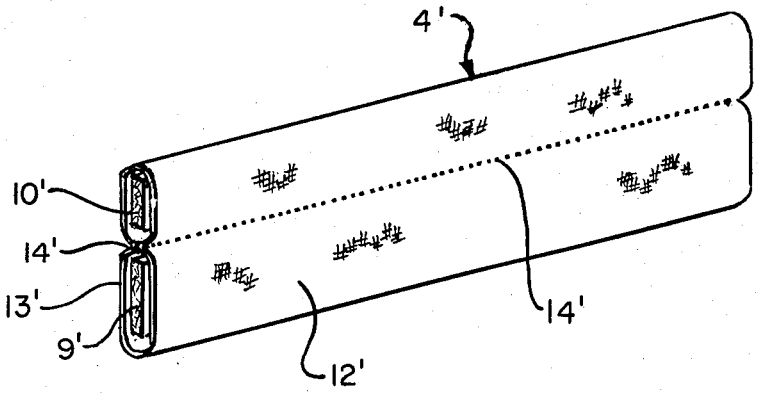
FIG. 5 is a perspective view of another embodiment of the stiffeners.

Specifically in FIG. 4 there has been shown the stiffener 4 composed of three laths 9,10,11 enclosed in sheaths formed of sheets 12, 13 connected by seams 14, 15 with a certain possibility of movement. The stiffener 4 is placed between the thicknesses 6 and 7 of foam, but it could also be placed between the thicknesses 7 and 8. They are all held in place by the cover 51 which is closed by the slide fastener 26. The stiffeners 4' made of the laths 9' and 10', as shown in FIG. 5, can also have the same length as the sheaths formed by the sheets 12', 13' and the seam 14'.

Ring-shaped handling loops 27 are provided which pass through the cover 51 and the end of the slit or incision between the thicknesses 7 and 8.

In use it is furthermore noted (FIG. 4) that, under the weight of the person 22 lying thereon, the laths 9, 11 for instance which are directly below the person 22 not only sink vertically in the foam 6,7,8 but also swing laterally (arrow 23), pushing in one of the side laths while inclining it (arrow 24) but raising the other side lath 10, including it also in the same direction (arrow 25) as the other side lath. This results in an effective wedging of the person lying on the bed since the laths 9 and 11 form a trough to prevent the body 22 from rolling, while the prominence formed by the juncture of the laths 9 and 10 limits the raising of the edge of the mattress and the harmful effects of too great an inclination of the central lath 9.

The essential advantages of stiffeners which are articulated in the lengthwise direction can be noted here.

Furthermore, another advantage of the articulation of the laths in a sheath which permits a certain movement of the laths with respect to each other is evident when a local force is applied to one end of the mattress, and particularly when a person sits on the edge or an end of the bed. At this time, a large amount of pressure is exerted on one end of a lateral lath which causes it to incline alone in the lengthwise direction without excessively deforming the rest of the mattress.

The covers 5, 51 are padded with a padding of synthetic or natural textile and they comprise, on the side of the mattress, at least one slit 16 (FIG. 2) or 26 (FIG. 4) over at least a portion of the periphery, the slit 16 or 26 being provided with a slide fastener or the like.

The incisions 2 and 3 have been shown in FIGS. 1 and 2 as being made along the two large lateral sides of the double mattress, that is to say they extend along slightly less than half of the total width of said mattress. In the case of a single-bed mattress, the incisions are also made along a large side of the mattress over practically the entire width thereof.

Figure 3:
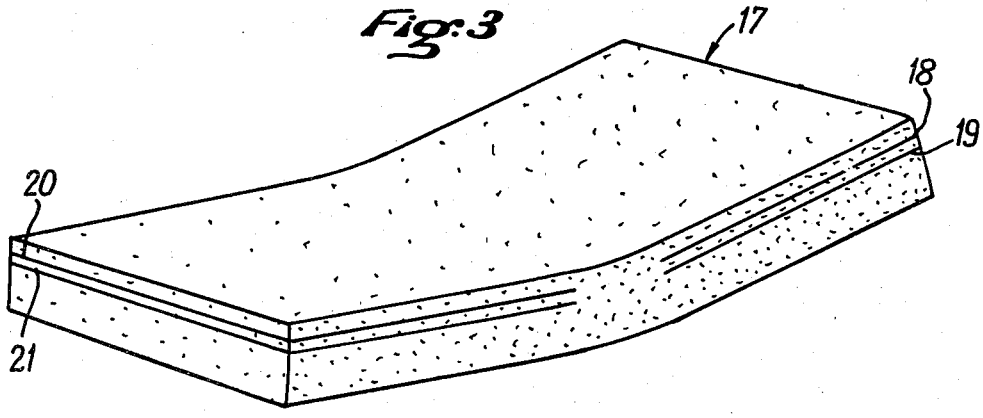
FIG. 3 is a perspective view of the foam padding by itself of a mattress intended for a patient or for hospitals.

For certain patients in hospitals, for instance, matress springs are used the head or foot of which can be raised for the needs of the patient. In this case, the mattress of the invention, such as described up to the present time, would not be suitable in view of the presence of the stiffeners 4. This can be remedied by arranging stiffeners in two parts along the direction of the length and for this one produces a mattress with a block of foam 17 (FIG. 3) having slits or incisions 18, 19, 20, 21 made along the two small end sides of the mattress and over a portion of their length. In this way, the unslit portion of the mattress can fold and serve as hinge not only for the different thicknesses separated by the incisions but also for the mattress as a whole.

In FIGS. 1 and 2 there has been shown a mattress consisting of a single block of foam 1 having four incisions such as 2 and 3. The same mattress can also be produced with two separate blocks of foam with the same or different incisions, the blocks being placed side by side. With this arrangement, each of the two persons separately can adjust as desired the hardness of the portion of the mattress which concerns him or her.

One drawback of some mattresses is that the padded cover shifts with respect to the central block of form and "turns" with respect to it. In order to avoid this drawback, one employs the annular loops generally arranged on the periphery of the mattress, that is to say on the lateral or end sides. In the case of the invention, the hinge of the thicknesses of foam 6,7,8 is directed towards the outer edge of the mattress; the annular handle loop is then passed through the padded and quilted cover 5 and through the end of the hinge formed between two thicknesses of foam 6 and 7 or 7 and 8. The annular handle loop therefore serves to block the block of foam with respect to the padded cover 5.

I claim:

1. In a mattress having stiffeners, particularly foam mattresses, having padding or foam portions, the improvement wherein one said portion is formed with first slits made by at least one perpendicular incision on one side of the portion of the mattress, the end of each incision constituting a hinge for the padding portions of the mattress which remain connected together on opposite sides of the incision, and which is opened in the manner of a book, stiffeners disposed in at least one of said slits, said stiffeners constituting a plurality of stiff laths, tubular sheaths of cross-sections and profiles corresponding to said laths, said tubular sheaths are connected to each other, said laths are disposed in said tubular sheaths, respectively, a padded and quilted covering being formed on the sides of the mattress with another slit over at least a portion of a periphery, a slide fastener disposed in said another slit.

2. The mattress as set forth in claim 1, wherein said first slits constitute a plurality of parallel slits which define therebetween and between two large faces of the mattress, different thicknesses of foam between each of said first slits and one of said large faces of said mattress, respectively.

3. The mattress as defined in claim 1 or 2, wherein said tubular sheaths are formed of two superimposed rectangular sheets of fabric connected parallel to one of their edges forming a connection between each sheath permitting a certain movement.

4. The mattress as defined in claim 3, wherein said stiffeners are all of the same length and said sheaths made of connecting fabric also have the same length.

5. The mattress as defined in claim 3, wherein said stiffeners of one series which is located in one same of said first slits having different lengths and widths, a central of said stiffeners are wider and longer and said sheaths are definitely shorter than said stiffeners.

6. The mattress as set forth in claim 3, wherein said rectangular shapes are sewn parallel to one of said edges.

7. The mattress as defined in claim 1, wherein said slits are made from a single large side of the mattress in such a manner that the hinges are parallel to said large side.

8. The mattress as defined in claim 1, wherein said slits are made from two large sides of the mattress in such a manner that said hinges are parallel to said large sides, said slits extending over only slightly less than one-half of the width of the mattress.

9. The mattress as defined in claim 1, wherein said slits are made from at least one small side of the mattress in such a manner that said hinges are parallel to said small side and extend over a portion of the length of the mattress.

10. The mattress as defined in claim 7 or 9, further comprising a padded cover covering said portions, loop-shaped handling handles for the mattress, arranged on lateral large sides thereof, said handles pass through both said padded cover and said portions of the mattress at the end of the slits at the level of the latter.

11. The mattress as defined in claim 7 or 9, further comprising a common cover for said portions, said portions for a double mattress arranged with two separate blocks of slit foam side by side disposed in said common cover.

* * * * *